United States Patent [19]

Thor

[11] 4,194,657

[45] Mar. 25, 1980

[54] SHOTGUN AMMUNITION CONTAINER

[76] Inventor: Gary Thor, 708 Ohio St., Vallejo, Calif. 94590

[21] Appl. No.: 1,308

[22] Filed: Jan. 5, 1979

Related U.S. Application Data

[63] Continuation-in-part of Ser. No. 820,708, Aug. 1, 1977, abandoned.

[51] Int. Cl.[2] ..... A41F 9/00; A42B 37/00; A42B 39/00

[52] U.S. Cl. ..... 224/252; 206/3; 206/811; 220/306; 220/375

[58] Field of Search ..... 206/3, 806, 387, 811; 220/375, 85 CH, 306; 224/15, 22, 23, 14, 13, 252, 269, 191

[56] References Cited

U.S. PATENT DOCUMENTS

| | | | |
|---|---|---|---|
| 1,455,803 | 5/1923 | Nofsinger | 206/806 |
| 1,809,696 | 6/1931 | Heilweil | 220/375 |
| 3,219,244 | 11/1965 | Blask | 224/15 |
| 3,893,725 | 7/1975 | Coulter et al. | 220/85 CH |
| 4,098,402 | 7/1978 | Rogg | 206/387 |

*Primary Examiner*—William T. Dixson, Jr.
*Attorney, Agent, or Firm*—Mark C. Jacobs

[57] ABSTRACT

A portable container for gun shells having a self-locking lid, and which may be belt mountable is disclosed. The container is sized preferably to accommodate shot gun shells and is water resistant.

9 Claims, 5 Drawing Figures

SHOTGUN AMMUNITION CONTAINER

RELATED APPLICATIONS

This application is a continuation-in-part of my copending U.S. application, Ser. No. 820,708, filed Aug. 1, 1977, now abandoned.

BACKGROUND OF THE INVENTION

Through the ages man has been a hunter. Formally he did it for survival. Today more often it is for sport. One problem that hunters, especially gun hunters, have had is the lack of a handy way of carrying ammunition to which ready access can be gained. Oftimes lone shells are carried in pockets and precious time is lost when the hunter has to fumble to find a few shells to reload his shotgun or rifle, especially when a prospective target is nearby.

Applicant is aware of the container of Capua, U.S. Pat. No. 3,332,594 but such does not provide quick access to the bullets.

The dispenser of Black, U.S. Pat. No. 3,219,244 suffers from the possibility that the bottom resilient member could be actuated thereby inadvertently dispensing ammunition through body movements of the wearer.

SUMMARY OF THE INVENTION

The invention herein is seen to comprise a box having a base and a removable self-locking lid, which lid is additionally secured to the base to prevent loss thereof.

The container is seen to be compact, easily loaded with shells and can be readily secured to the belt or clothing of the user.

Accordingly, it is an object of this invention to provide a compact durable shell container for use by hunters.

Another object is to provide a container suitable for the storage of shotgun shells or other ammunition which is light in weight and easy to manufacture.

Still another object is to provide a shell container which is substantially water tight and which allows for ready access by the shooter to the contents.

Other objects of the invention will in part be obvious and will in part appear hereinafter.

The invention accordingly comprises the product possessing the features, properties and the relation of components which are exemplified in the following detailed disclosure, and the scope of the application of which will be indicated in the claims.

For a fuller understanding of the nature and objects of the invention, reference should be had to the following detailed description and the accompanying drawings.

DESCRIPTION OF THE PREFERRED EMBODIMENT

Figure 1:
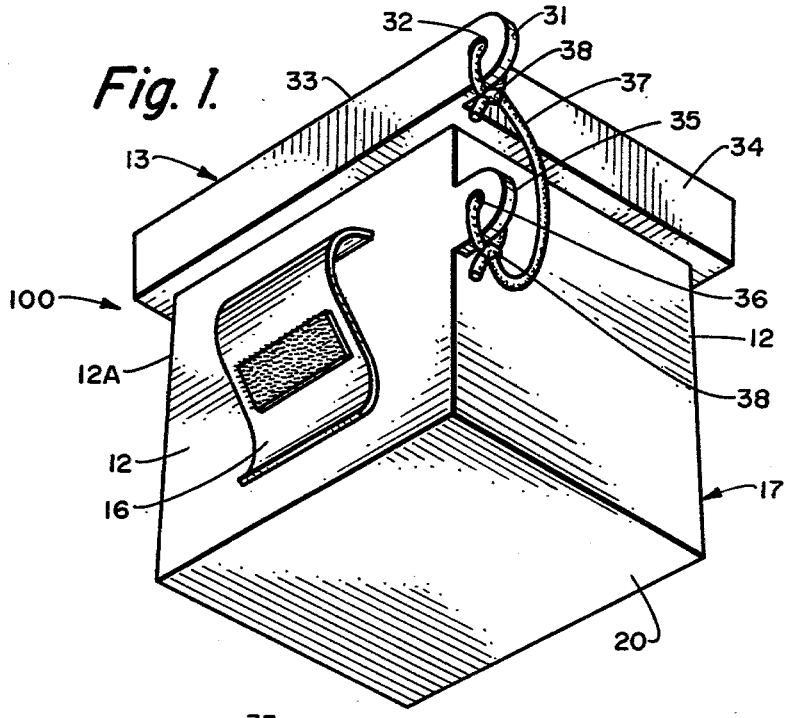
FIG. 1 is a bottom perspective view of one embodiment of this invention.

With reference to FIG. 1, there is provided container 100 constructed in accordance with the invention as shown in the open position. The container 100 comprises a box or bottom 17 having a bottom wall 20 and substantially vertically extending sidewalls 12. One such wall has been designated as 12A to illustrate which wall is cut away in FIG. 2. Per FIG. 3 the upper portion of the sidewalls 12 has a round ridge 14 molded on the exterior surface of the front and rear walls, and a similar ridge 40 molded into the side walls in axial alignment therewith. The rear wall has a belt clip 16 integrally or otherwise fixedly attached thereto.

The detachable lid 13 consists of a top 33 having at the edges thereof downwardly depending sidewalls 34. Tab 31 is disposed at the corner forming the junction of two of the walls 34, here shown to be the rear and right side wall. It is preferable for said tab 31 not to project rearwardly to avoid interference with the location between the wearer's belt and clip 16. If desired tab 31 could extend forwardly. While shown at one corner, it is within the scope of the invention for the tab to be disposed at any location along the length of right side wall 34. Indeed the tab 31 could be placed on side wall 34A, the left side wall if desired. Tab 31 has a central aperture 32 therethrough for the insertion of connecting string 37 which is knotted at one end 38 to attach it to the tab 31.

A similar tab 35 having an aperture 36 therein is disposed normal to the right side wall 12 of box 17. All of the comments pertinent to the disposition of tab 31 are pertinent here as well. For style and ease of operation, the two tabs should preferably be facing the same direction and more preferably in vertical alignment, as shown. However, preferably the apertures 32 and 36 are horizontally disposed.

The opposite end of string 37 is knotted at 38 through aperture 36 to thereby detachably secure lid 13 to box 17. If desired, tabs 31 and 35 may be oriented 90° to provide vertical apertures.

Figure 2:
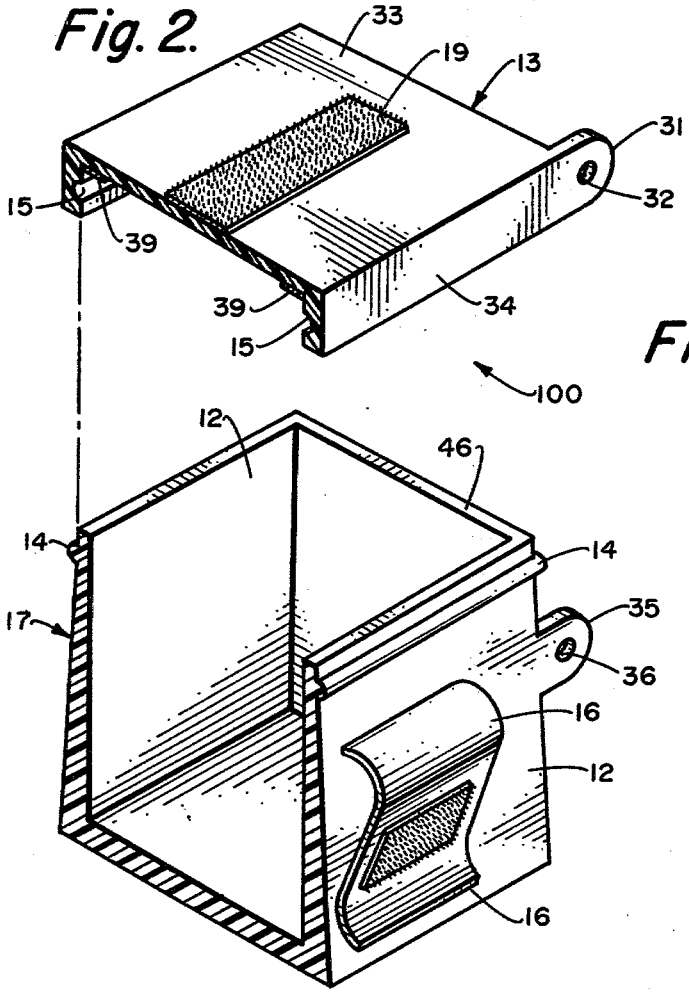
FIG. 2 is an exploded perspective view of the device of this invention wherein one sidewall of the bottom section and the lid have been removed.
Figure 3:
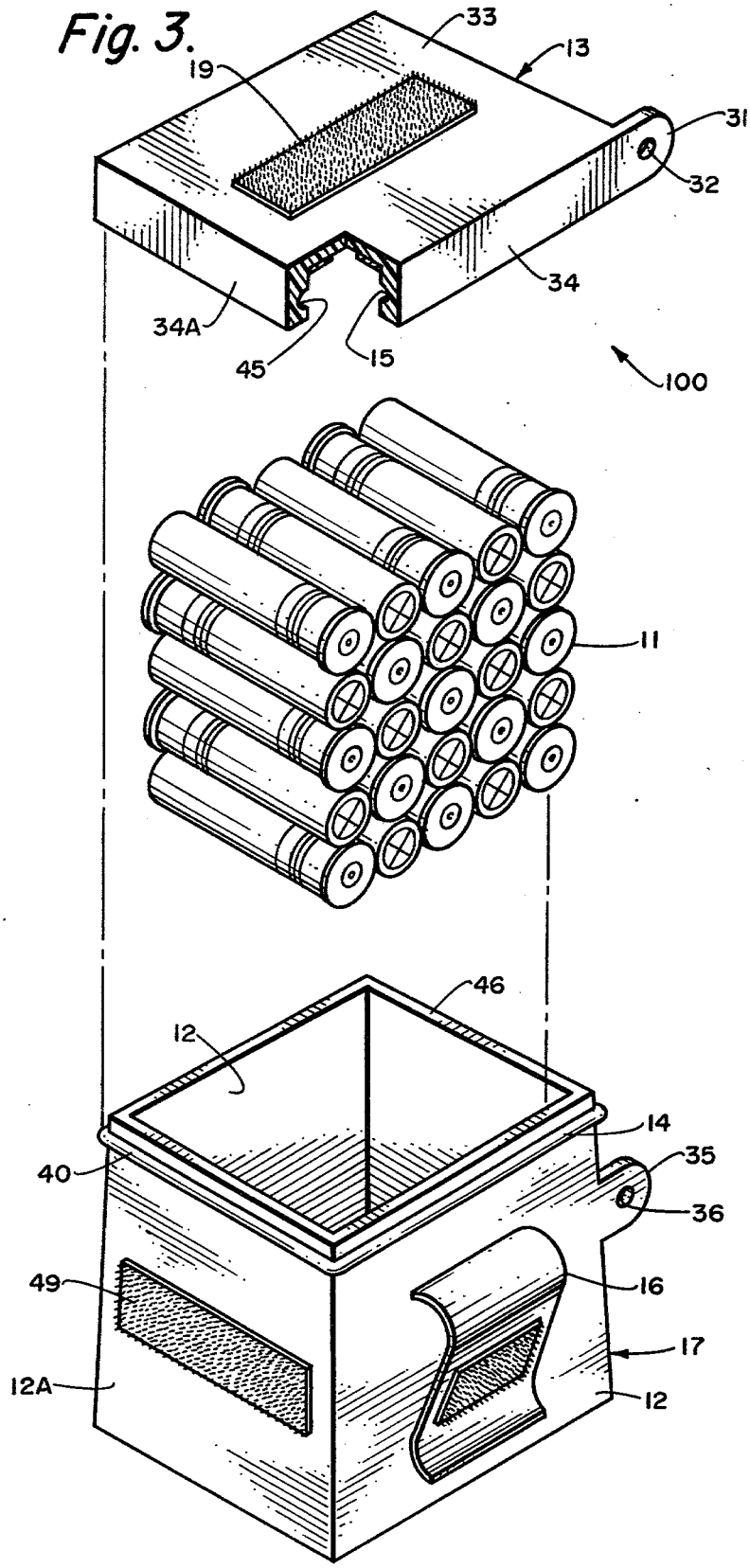
FIG. 3 is an exploded perspective view of the container constructed in accordance with one embodiment of this invention.

In FIGS. 2 and 3 one embodiment of container 100 is further illustrated. The box side walls 12 are shown as they engage the bottom of the container 20. The ridges 14 and 40 are shown as they are molded to the upper portion of box side walls 12. The lid top 13 is shown separated from box 17 due to the absence of string 37. Inwardly extending groove 15, in phantom in FIG. 3, and in FIG. 1, is shown as it is constructed into the lower portion of the internal surface of the downardly depending walls 12 of the lid.

It is to be noted that left side wall 12 is designate 12A in FIG. 3 to further indicate the fact that it is this wall that is missing in FIG. 2.

Disposed along substantially the entire depth of wall 12A at a convenient elevation, preferably around the middle for proper balance, is disposed a strip of Velcro® 49. The Velcro® material 49 may be adhesed to wall 12A by a suitable glue or self-adhesive Velcro® available in the marketplace. Velcro® is an engaging means comprising a pad of nylon hooks which engages a pad of complimentary loops for forming a detachable bond of one time to another. Velcro® is a well known material available in the marketplace from Velcro S.A. of Friebourg, Switzerland or its licensee.

It is to be seen that preferably, as illustrated here, the tabs 31 and 35 are disposed on the opposite side wall from Velcro® strip 49. The choice of left or right for either is at the choice of the practitioner.

Lid 13 is seen to include a similar Velcro® strip 19 of convenient size disposed on the top outside surface thereof. At the midportion of the clip there is shown another Velcro® strip 19 which can serve to better secure the clip to the belt of the wearer by engaging the fabric of the trousers, thereby adding in the disposition of the clip at its desired position on the belt. Obviously this additional strip is optional.

Demonstrating the intended use of the invention, an array 11 of shotgun shells, stacked five rounds wide and five rounds tall, is shown in FIG. 3. While shown in the preferred orientation, horizontal, for easier handling and quicker removal, it is within the scope of the invention, but less preferred, to size the container for vertical storage of the shells 11. Thus, the container can be adapted to maintain all guages and lengths of shotshell or other ammunition securely. The application of the detachable lid 13 is accomplished by a downward vertical pressure until the groove 15 on the lid side walls as aforesaid engages the ridge 14 of the box side walls. With the presence of ridges 40, they would also engage their appropriate groove 45 until the ridges snap into the lid whereby the bottom becomes removably secured to the lid.

Figure 5:
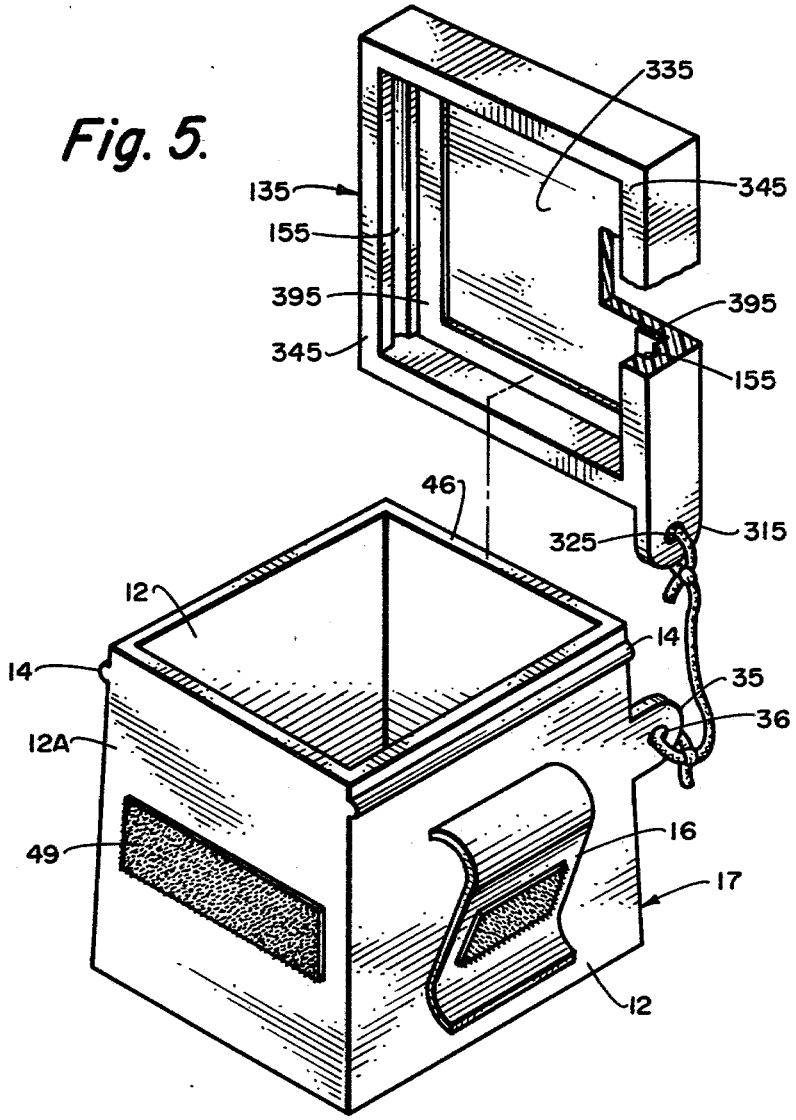
FIG. 5 is a perspective view of another embodiment of this invention wherein the container is in an open position.

When lid 135, per FIG. 5 is employed, it is seen that upon engagement of ridge 14 with groove 15, gasket 395 will assume a contact relationship with lip 46, the surface of thickness of wall 12, to help ensure an even better water tight seal.

At all times string 37 will remain almost taut since little extra should be provided such that when the lid is detached and then let go, it will dangle but a few inches from the box, again saving time for re-location when it is desired to reseal container 100 after removing the desired shells.

With the detachable lid closed, the shotshell container may be turned in any position while maintaining the contents securely. Removal of the detachable lid requires upward vertical pressure until such time the grooves 15 and 45 if present of the lid disengage the ridge 14 and 40 if present of the box side walls. The shotshell container is intended for loose storage of shotshell ammunition in such a manner that the ammunition need not be retained in the array when the detachable top is removed, but may be moved or shifted for convenient access.

Figure 4:
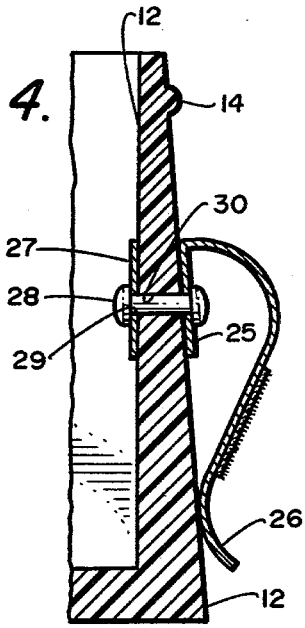
FIG. 4 is a rear elevational view of a second embodiment of the bottom portion of this invention.

FIG. 4 is a sectional view of an alternate belt clip. Clip 26 is seen to include an integral nonspring vertical extension 25 which attaches to the leading edge thereof and preferably formed therewith. Extension 25 is held in abutting relationship to side wall 12 by rivet 28 inserted into aperture 29 in said plate 27, through the aligned apertures 30 of said wall 12. Optionally, a retainer plate 27 may be juxtaposed against the inside of wall 12 such that apertures aligned with apertures 29 would extend through. Such retainer plate can be of thin steel or aluminum and is intended for reinforcement of the plastic wall 12.

It is to be understood that while two rivets are shown securing clip 26 and its extension 25 more or only one need be or can be employed. Clip 26 and extension 25 may be constructed of steel, for example.

The embodiment of FIG. 5 is similar to that of FIG. 3, except for the presence of lid 135 without ridges 45. While a lid 13 such as shown in FIG. 2 or FIG. 3 having both grooves 15 and 45, it is preferable to employ a lid such as 135 which has only grooves 155 therein, re front and back. The absence of side grooves increases the strength of lid 135 since such grooves would receive no ridges.

In addition, to ensure a tight seal to protect ammunition 11 from water contact, gasket 395 usually of synthetic rubber may be either separatedly adhesed onto the surface of the interior of top wall 335 of lid 135 or the gasket may be integrally cast into place in same at the time of manufacture using conventional technology. Reference is made to FIG. 5 wherein the tab is designated 315 with its aperture designated 325.

Obviously the concept of employing an extra gasket such as 395 is equally applicable to lid 13, and it is within the scope of the total invention to include same and such would be designated 39. It is also seen that it is just as applicable to employ the clip mechanism of FIG. 4 for the container structure of FIG. 5 as well.

From the point of view of manufacture, the embodiment of FIG. 3 is best made having a flexible lip 13 such as one made of polypropylene or polyethylene. If a more rigid plastic, such as ABS, were used, it might be difficult to remove the lid from the bottom. Therefore ABS and other rigid plastics, such styrene, should preferably be employed for the embodiments of FIG. 5.

In any event, the box of said container should have rigid sidewalls, and the walls of the lid, at least those having the grooves therein should possess some degree of flexibility to permit opening and closing of the container.

The ammunition container of this invention with its self-locking lid, which remains secured to the box even after unsealing of the lid, is seen to possess many advantages over the prior art, such as ease of opening and closure and the ability to be cheaply and easily manufactured.

While the forms of apparatus described constitute the preferred embodiments, it is to be understood that the invention is not to be limited to the forms of the apparatus as presented herein, and that changes may be made therein without departing from the scope of the invention.

As is seen, Velcro® strips 19 and 49 have been provided to allow alternate mount means for the container 100 of this invention upon the clothing of the wearer. Thus, a hunter having a strip of complimentary Velcro® on his sleeve, or elsewhere, could secure the device of this invention to his sleeve or such other location as possessed the complimentary Velcro®, e.g. a boot.

A Velcro® strip on the side wall having tab 35 is not suggested as the user may believe he should attach the removed lid thereto whereas in fact quicker replacement of the lid to the box can be attained if the lid is allowed to dang'e free after separation from the box.

I claim:

1. A two-piece ammunition shell container comprising a box and a self-locking detachable lid, and sealing means for said container;

said lid having a top and four downwardly depending side walls, each of said walls having a groove extending inwardly from its interior surface;

the box having a base and four upstanding rigid vertical side walls each of which has an outwardly disposed ridge on the top portion of the exterior surface thereof adapted to engage the groove of said lid's corresponding side wall, wherein said grooves are sized to engage said ridges, the length and width of said lid being slightly larger than the length and width of said box such that upon engagement of said ridges with said grooves when the lid is applied, a water resistant sealing means to prevent moisture entry is formed;

means to interconnect said lid to said box to prevent separation of said lid from said box when said lid is detached; and a belt clip attached to one side of said box.

2. The container of claim 1 further including a gasket on the inside of the top of said lid adjacent to each of said side walls.

3. The container of claim 2 wherein the means to attach the lid to the box comprises a pair of apertured tabs mounted to one or each of said lid and said box, and a string connected to both of said tabs.

4. The container of claim 3 further including a strip of Velcro® on the outside surface of the top of said lid.

5. The container of claim 4 additionally including a strip of Velcro® on the outside of at least one of the side walls of said box other than the side wall having the clip thereon.

6. The container of claim 4 wherein the container is made of molded plastic and the belt clip is integrally formed as part of the box.

7. The container of claim 4 wherein the belt clip is detachably secured to said side wall.

8. The container of claim 1 wherein the means to attach the lid to the box comprises a pair of apertured tabs mounted one on each of said lid and said box and a string connected to both of said tabs, further including a strip of Velcro® on the outside surface of the top of said lid.

9. The container of claim 1 further including a gasket on the inside of the top of said lid adjacent to said side walls, further including a strip of Velcro® and including a strip of Velcro® on the outside of at least one of the side walls of said box other than the side wall having the clip thereon, and also including a strip of Velcro® on the outside surface of the top of said lid.

* * * * *